US008890676B1

(12) United States Patent
Heath

(10) Patent No.: US 8,890,676 B1
(45) Date of Patent: Nov. 18, 2014

(54) ALERT MANAGEMENT

(75) Inventor: Taliver Brooks Heath, Mountain View, CA (US)

(73) Assignee: Google Inc., Mountain View, CA (US)

( * ) Notice: Subject to any disclaimer, the term of this patent is extended or adjusted under 35 U.S.C. 154(b) by 499 days.

(21) Appl. No.: 13/187,183

(22) Filed: Jul. 20, 2011

(51) Int. Cl.
*G08B 19/00* (2006.01)

(52) U.S. Cl.
USPC ..... 340/521; 340/3.1; 340/506; 340/508; 340/511; 340/522; 340/525; 700/17; 700/19

(58) Field of Classification Search
CPC ..... G08B 19/00; G08B 29/22; G08B 29/16; H04L 41/0631; H04L 41/0659; H04M 3/10
USPC ..... 340/521, 522, 508, 525, 3.1, 506, 511; 700/17, 19
See application file for complete search history.

(56) References Cited

U.S. PATENT DOCUMENTS 5,260,687 A * 11/1993 Yamauchi et al. ..... 340/522
6,188,973 B1 * 2/2001 Martinez et al. ..... 702/188
6,977,587 B2 * 12/2005 Pradhan et al. ..... 340/539.26
7,525,422 B2 * 4/2009 Bishop et al. ..... 340/522
2005/0146426 A1 * 7/2005 Pereira et al. ..... 340/506
2005/0181835 A1 * 8/2005 Lau et al. ..... 455/567
2009/0070628 A1 * 3/2009 Gupta et al. ..... 714/26
2009/0182794 A1 * 7/2009 Sekiguchi ..... 707/206
2010/0109860 A1 * 5/2010 Williamson et al. ..... 340/508
2010/0211192 A1 * 8/2010 Stluka et al. ..... 700/12
2010/0218104 A1 * 8/2010 Lewis ..... 715/736
2010/0332432 A1 * 12/2010 Hirsch ..... 706/21
2011/0010654 A1 * 1/2011 Raymond et al. ..... 715/772
2012/0331124 A1 * 12/2012 Venkatesh et al. ..... 709/224

* cited by examiner

*Primary Examiner* — Benjamin C Lee
*Assistant Examiner* — Quang D Pham
(74) *Attorney, Agent, or Firm* — Fish & Richardson P.C.

(57) ABSTRACT

A first alert and a second alert are received. The first alert indicates a first fault related to a first component of the multiple components and the second alert that indicates a second fault related to a second component of the multiple components. The first component affects the second component such that the first fault caused the second fault. A correlation between the first alert and the second alert is determined and, based on the determined correlation, a determination is made that the first fault is a root cause of the first alert and the second alert. An indication that the first fault is the root cause of the first alert and second alert is provided.

18 Claims, 7 Drawing Sheets

ALERT MANAGEMENT

TECHNICAL FIELD

The following disclosure relates to managing multiple alerts in a system.

BACKGROUND

When various interconnected parts of a system are separately monitored, one incident can trigger several alerts. Responding to a large number of alerts is often expensive as well as redundant.

SUMMARY

In one aspect, the present disclosure features a computer-implemented method of handling alerts in a data center that includes multiple components in which a fault in one of the components can result in a cascade of faults in other components. The method includes receiving, at one or more processing devices, a first alert that indicates a first fault related to a first component of the multiple components and a second alert that indicates a second fault related to a second component of the multiple components. The first component affects the second component such that the first fault caused the second fault. The method also includes determining, using the one or more processing devices, a correlation between the first alert and the second alert and determining, based on the determined correlation, that the first fault is a root cause of the first alert and the second alert. The method further includes providing an indication that the first fault is the root cause of the first alert and second alert.

In another aspect, a data center includes multiple, components in which a fault in one of the components can result in a cascade of faults in other components. The data center also includes an alarm unit and a plurality of monitoring devices configured to monitor the multiple components of the data center and trigger an alert on occurrence of a fault related to a component. The alarm unit is configured to receive a first alert and a second alert. The first alert indicates a first fault related to a first component of the multiple components and the second alert indicates a second fault related to a second component of the multiple components, wherein the first fault resulted in the second fault. The alarm unit is further configured to determine a correlation between the first alert and the second alert and determine, based on the determined correlation, that the first fault is a root cause of the first and second alerts. The alarm unit is also configured to provide an indication that the first fault is the root cause of the first alert and the second alert In another aspect, the application features a computer program product that is encoded on a computer readable storage device. The computer program product is operable to cause one or more processing devices to perform operations that include receiving a first alert and a second alert. The first alert indicates a first fault related to a first component of the multiple components and the second alert indicates a second fault related to a second component of the multiple components. The first component affects the second component such that the first fault causes the second fault. The operations also include determining, using the one or more processing devices, a correlation between the first alert and the second alert and determining, based on the determined correlation, that the first fault is a root cause of the first alert and the second alert. The operations further include providing an indication that the first fault is the root cause of the first alert and second alert.

Implementations can include one or more of the following. Determining the correlation between the first alert and the second alert can include determining the correlation using a set of predetermined rules. The set of predetermined rules can reflect the dependency of the second component on the first component. The set of predetermined rules can include a directed graph that reflects the dependency of the second component on the first component. Determining the correlation between the first alert and the second alert can include determining the correlation using a time aware Bayesian system. An indication that the second alert can be ignored can be provided. The second alert can also be suppressed. The first component can be part of an electrical system of the data center and the second component can be a part of a cooling system of the data center. Based on the root cause, triggering of at least a third alert can be predicted wherein the third alert indicates a third fault in one of the multiple components. Triggering of the third alert can be prevented. An indication that the third alert can be ignored can be provided before triggering of the third alert.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

The present disclosure describes methods and systems for determining a root cause of multiple alerts triggered by related events at various parts of a system. In many applications, alerts can be triggered by various (e.g. tens, hundreds or thousands) monitors in different parts of a system. This can result in information overload, and lead to some key alerts being ignored. In some cases, resources (e.g. time) may be spent investigating alerts triggered by incidents that occur as consequences of another incident that has already been dealt with. The alerts triggered at different parts of a system can be managed more effectively by identifying a root cause of a related set of alerts. Identification of a root cause can help determine an additional set of alerts that are or will potentially be triggered due to the common root cause. In some cases, once a root cause is identified, such downstream alerts, that have already been triggered, are ignored or at least can be ignored. Predicted downstream alerts can also be suitably flagged or preemptively stopped from being triggered.

Identification of a root cause for related set of alerts may provide several advantages. For example, by addressing the root cause, potentially a large number of alerts can be addressed in a quick and efficient way. The available resources can be channeled effectively, thereby reducing redundant actions as well as wastage of available resources. By predicting which downstream alerts may potentially be triggered, the number of alerts actually produced can be reduced for better alert management. In some cases, identified root causes can be stored and used to determine root causes of future alerts.

Even though the alert management methods and systems described herein can be used in various applications, the present document describes such methods and systems as used in a datacenter facility. However, the datacenter example is used for illustrative purposes and should not be considered limiting. In general, the alert management methods and systems described herein can be used in various other systems that use multi-stage monitoring and alerting.

Figure 1A:
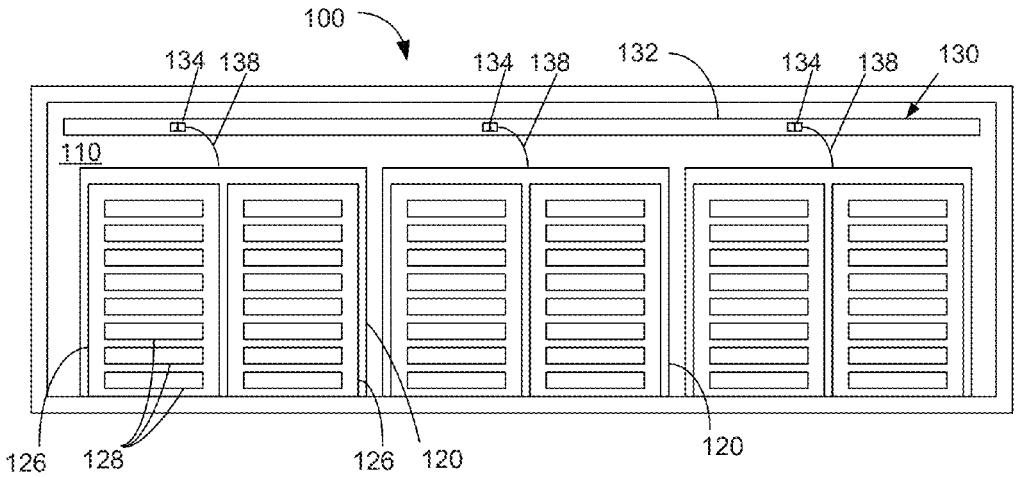
FIGS. 1A and 1B are side and plan views of an example of a facility that serves as a datacenter.
Figure 1B:
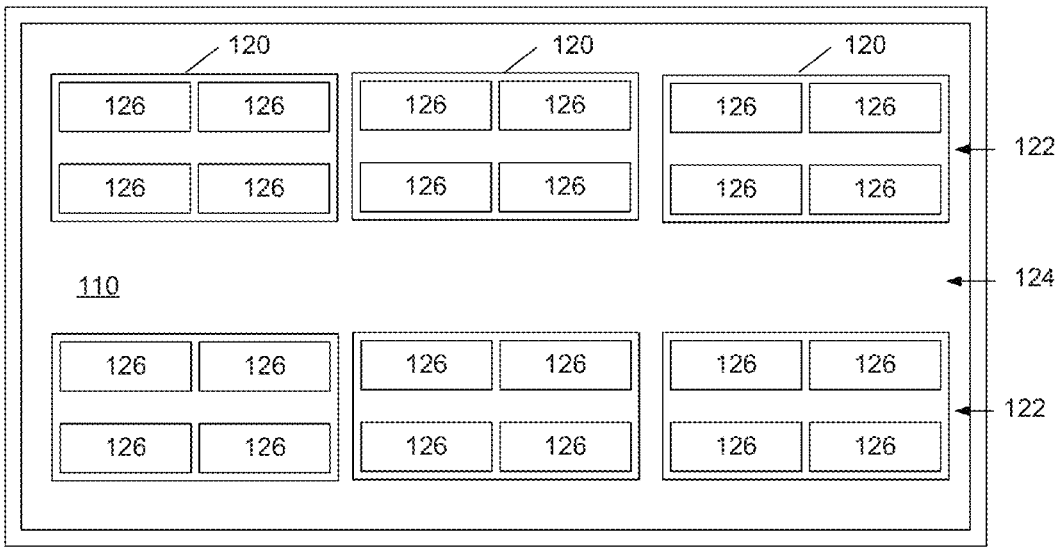

FIGS. 1A and 1B are side and plan views to illustrate an example of a facility 100 that serves as a datacenter. The facility 100 includes an enclosed space 110 and can occupy essentially an entire building, or be one or more rooms within a building. The enclosed space 110 is sufficiently large for installation of numerous (dozens or hundreds or thousands of) racks of computer equipment, and thus could house hundreds, thousands or tens of thousands of computers.

Modules, e.g., cages 120, of rack-mounted computers are arranged in the space in rows 122 separated by access aisles 124. Each cage 120 can include multiple racks 126, e.g., four to eight racks, and each rack includes multiple computers 128, e.g., trays.

The facility also includes a power grid 130, which, in this implementation, includes a plurality of power distribution "lines" 132 that run parallel to the rows 122. Each power distribution line 132 includes regularly spaced power taps 134, e.g., outlets or receptacles. The power distribution lines 132 may be bus bars suspended on or from a ceiling of the facility. Alternatively, bus bars could be replaced by groups of outlets independently wired back to a power supply, e.g., elongated plug strips or receptacles connected to the power supply by electrical whips. As shown, each cage 120 can be connected to an adjacent power tap 134, e.g., by power cabling 138.

The rack-mounted computers generate heat during their operations. The facility 100 can also include arrangements for cooling the computers housed in the facility. Such cooling systems are described with reference to FIG. 2 that shows an example of an architecture for a datacenter.

Figure 2:
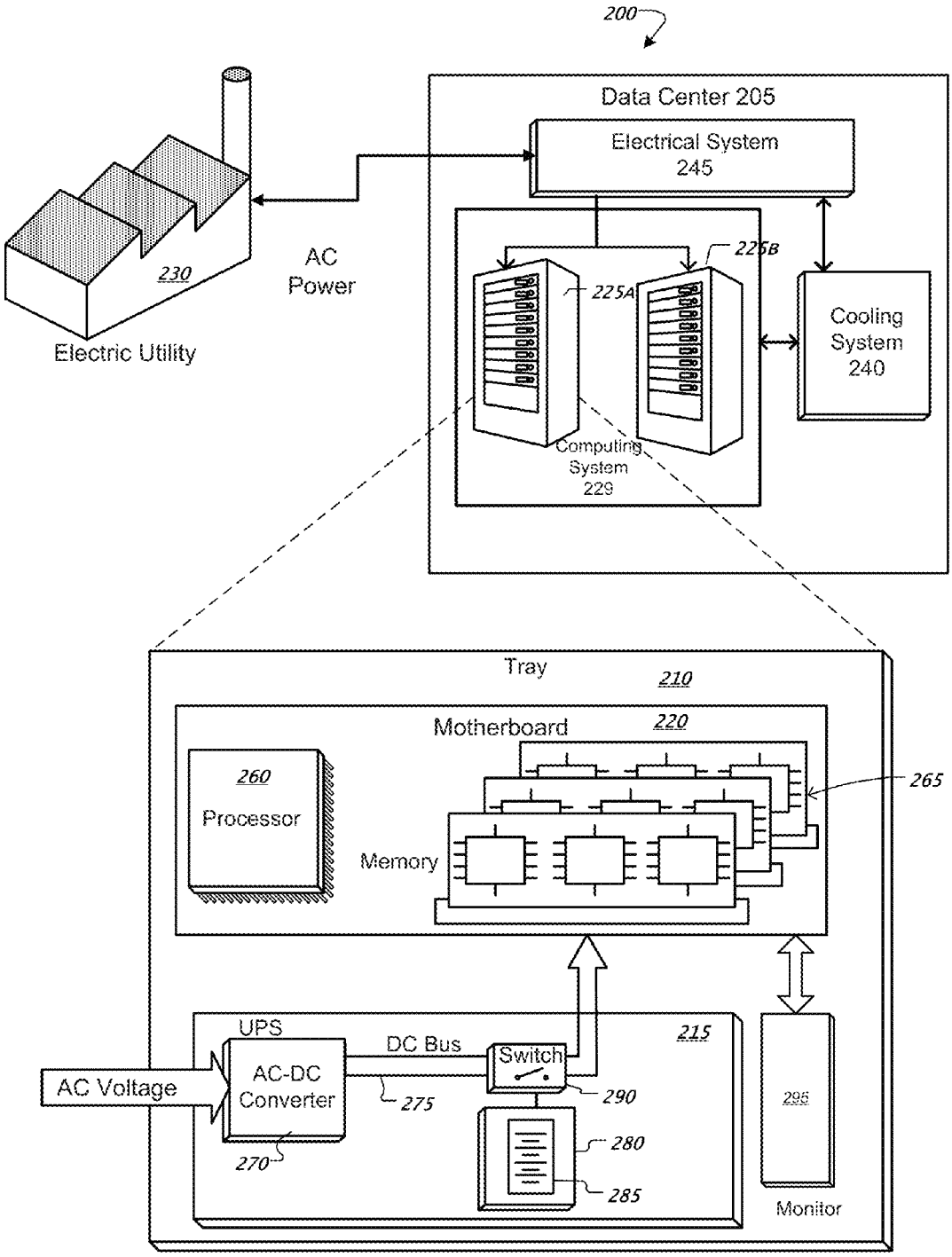
FIG. 2 is a schematic diagram illustrating an example of an architecture for a datacenter.

FIG. 2 is a schematic diagram illustrating an example of an architecture 200 for a datacenter 205 in which each of a number of modular rack-mounted bases (which may also be referred to as trays) 210 includes an uninterruptible power supply (UPS) 215 operating to power components on a computer motherboard 220. In some implementations, at least some of the trays can be connected to one another via a network switch such that the trays together form a distributed computing network. In general, a primary power source, such as an electric utility 230, provides operating power to the datacenter.

In the depicted example, the datacenter 205 includes a computing system 229, a cooling system 240 and an electrical system 245. The computing system 229 includes a number of racks 225A, 225B, (each of which can be referred to, in general, as a rack 225) that contain a number of the trays 210. The racks 225A-225B may be powered, for example, by three-phase AC power that is delivered to the datacenter 205 from an electric utility 230. The power to the computing system 229 and other parts of the datacenter 205 can be routed through the electrical system 245.

A datacenter may provide a large number of processors, each having one or more cores. As processor technology improves, each processor or core may draw less power, but the number of cores per processor may increase. Larger datacenters may employ many more processors, including 50,000, 100,000, or an even higher number of processors. These may be distributed in racks having, for example, 120 or 240 processors and over 400 cores per rack. In some implementations, a datacenter can house 300,000 or more cores.

The large number of processors in the datacenter 205 can generate considerable amount of heat during their operations. The datacenter 205 can include a cooling system 240 that helps dissipate the heat generated at the datacenter. In general, the cooling system 240 includes channels in close proximity to the processors (or other units that need to be cooled) through which a fluid is circulated to dissipate the heat from the units. The temperature of the circulated fluid is kept lower than the temperature of the units such that heat from the units are transferred to the circulating fluid and carried out of the datacenter. In some implementations, fluids such as air or water can be used in the cooling system 240.

The cooling system 240 can include multiple cooling units for cooling the various units of the datacenter 205. For example, a separate cooling unit can service each of the racks 126 or trays 210. Similarly, each of the modules 120 and the datacenter 205 can have separate dedicated cooling units. In some implementations, each of the cooling units can be monitored for performance or faults by monitoring units. The monitoring units can track various performance and operating parameters related to the cooling units including, for example, power supply to the cooling unit, temperature of the datacenter unit serviced by the cooling unit, fluid temperature in the cooling unit, and rate of fluid flow. Each of the monitoring units can be configured to trigger an alert if a monitored parameter is found to be outside a predefined range. Operating power to the cooling system 240 is routed through the electrical system 245.

The electrical system can include circuitry to manage and condition the power supplied from the electric utility 230 for distribution among various units and systems of the datacenter 205. For example, the electrical system 245 can include one or more transformers that step down the voltage supplied from the electric utility to voltages needed at the input of various units. Similarly, the electrical system 245 can include other circuitry such as AC to DC converters, surge protectors, and power monitoring units. In some implementations, the electrical system 245 also includes a power management unit that is communicably connected to the trays in the datacenter 205. The power management unit can monitor power and/or energy usage by the various trays in the datacenter 205 and allocate tasks to different trays accordingly. In some implementations, the power management unit can ensure that the datacenter does not exceed the maximum allowed power usage. For example, each tray in a rack may be allocated a particular amount of power usage to remain below the maximum power usage for the rack. The tasks assigned to the trays may be controlled so that the power usage of the trays remains below the maximum power usage.

In various implementations, the motherboard 220 may include two, three, four, or any other practicable number of processors 260. In some implementations, the motherboard 220 may be replaced with or augmented by a tray of data storage devices (e.g., hard disc drives, flash memory, RAM, or any of these or other types of memory in combination). In such implementations, the UPS 215 and the battery 285 may be integrated with the data storage devices and supported on the tray 210. Alternatively, the battery 285 can be off the rack or one battery 285 can be shared by data storage devices from multiple trays 210.

In various implementations, a digital processor may include any combination of analog and/or digital logic circuits, which may be integrated or discrete, and may further include programmable and/or programmed devices that may execute instructions stored in a memory. The memory 265 may include volatile and/or non-volatile memory that may be read and/or written to by the processor 260. The motherboard 220 may further include some or all of a central processor unit(s) (CPU), memory (e.g., cache, non-volatile, flash), and/or disk drives, for example, along with various memories, chip sets, and associated support circuitry.

The UPS 215 processes an AC input voltage signal that is delivered to each of the trays 210. In some examples, the AC input voltage signal may be received from the AC mains. The UPS 215 includes an AC-to-DC converter 270 that converts the AC input voltage signal to a regulated DC voltage. The converter 270 outputs the regulated DC voltage onto a DC bus 275. In some implementations, the AC-to-DC converter 270 may regulate the DC voltage to a static set point.

If the AC input voltage signal falls outside of a normal range, such as during a fault condition, or a power outage, a detection circuit (not shown) may send a signal indicative of this condition. In response to detecting the fault condition, a battery circuit 280 may be configured to connect the battery 285 across the DC bus 275, such as by actuating switch 290, so that the motherboard 220 can continue to operate substantially without interruption. The battery 285 may continue to provide operating power to the circuits on the motherboard 220 until the battery 285 substantially discharges. The battery circuit 280 may include circuitry capable of controlling the charging and/or discharging the battery across the DC bus 275 in various operating modes. In some implementations, a channel of the cooling system 240 can be suitably disposed in proximity to the tray 210 such that heat generated by the tray 210 is dissipated. Such dissipation of heat allows the tray and the processor on the tray to operate continuously without overheating or failing.

In some implementations, the tray 210 includes a monitor 295. The monitor 295 can also be referred to as a monitoring device. The monitor 295 can be configured to track various operating and/or performance parameters related to the tray. Such parameters can include, for example, temperature of the tray, energy consumption, temperature of fluid in the cooling channel and processor load. The monitor 295 can be configured to trigger one or more alerts if a monitored parameter is detected to lie outside a predefined range. For example, the monitor 295 can be configured to trigger an alert if the temperature of the tray (or the environment thereof) increases above a predetermined value. The alerts indicate an occurrence of a fault condition and can in turn trigger a visual, audible or other form of alarm. In some implementations, the monitor can also be configured to shut down the monitored unit (the tray 210 in this example) if the triggering fault condition is not addressed within a predetermined time or if the degree of fault condition is determined to be unsafe. For example, if the tray 210 continues to stay at an elevated temperature beyond a predetermined time limit or if the temperature increases to an unacceptable level, the monitor 295 may trigger a shutdown at least a portion of the tray 210.

It should be noted that while the monitor 295 has been described herein with reference to the tray 210, substantially similar monitors may also be deployed elsewhere in the datacenter 205. For example, each rack or module can have dedicated monitors tracking corresponding operating and/or performance parameters. Similarly, other systems such as the electrical system 245 or the cooling system 240 may have their own monitors. In some implementations, one or more parts or units of the datacenter can share a monitor 295. For example, a cooling unit that cools the tray 210 can be monitored using the monitor 295 disposed in the tray.

In some implementations, the processor 260 is a single core processor. In some implementations, the processor 260 is a multi-core processor such as a dual-core processor (e.g. AMD Phenom II X2, Intel Core Duo etc.), quad-core processor (e.g. AMD Phenom II X4, the Intel 2010 core line that includes 3 levels of quad core processors, etc.) or hexa-core processor (e.g. AMD Phenom II X6, Intel Core i7 Extreme Edition 980X, etc.). In general, a multi-core processor implements multiple processing units in a single physical package. The cores in a multi-core processor may be completely independent or may share some resources such as caches. In some implementations, a multi-core processor can implement message passing or shared memory inter-core communication methods. In such cases, the cores of a multi-core processor are interconnected. Common network topologies that interconnect cores include bus, ring, 2-dimensional mesh, and crossbar. Multi-core processors can be homogeneous or heterogeneous. Homogeneous multi-core processors only include cores that are substantially identical to each other. Heterogeneous multi-core processors have cores that are not identical.

Figure 3:
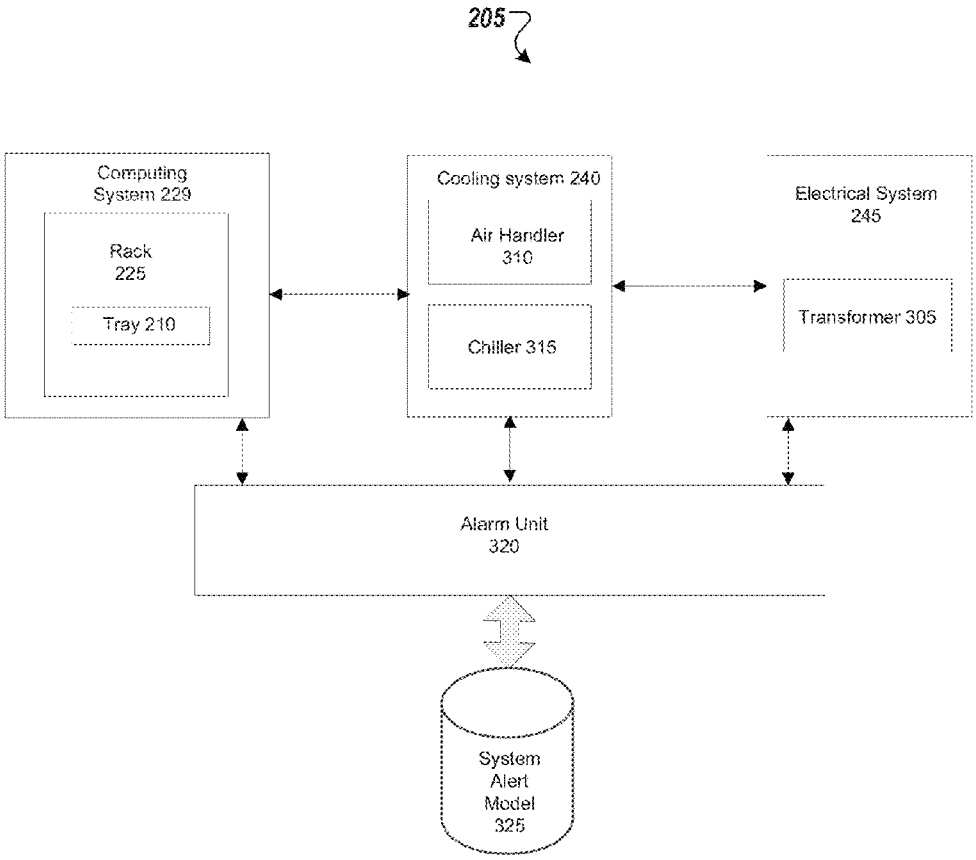
FIG. 3 is a block diagram illustrating an example of an architecture of a datacenter with an alarm unit.

Referring now to FIG. 3, a block diagram illustrates an example of an architecture of a datacenter 205 with an alarm unit 320 that can provide an indication of the root cause of multiple alerts. In some implementations, the alarm unit 320 is connected to the computing system 229, the cooling system 240 and the electrical system 245 and configured to receive the alerts triggered at each of the systems. The alerts can be triggered at various parts of the data center. For example, in the computing system 229, the alerts can be triggered at a rack 225, at a tray 210 or elsewhere in the computing system 229. Similarly, in the cooling system the alerts can be generated, for example, at an air handler 310 or a chiller 315. The chiller 315, which can include a compressor, provides cold air to the air handler 310, which distributes the cold air to the datacenter units that have to be cooled. The air handler can include a fan or a blower. The air handler 310 and the chiller 315 can be controlled, for example by a computing device, based on one or more control parameters such as temperature and pressure. For example, the chiller 315 can be configured to be switched on only when the air temperature is higher than a pre-set level. Similarly, the air handler 310 can also be switched on or off based on temperature and/or air pressure. Failure, malfunction or other operating/performance parameters can be monitored for the air handler and/or cooler and alerts can be generated if a monitored parameter is determined to be outside a predefined range. In case of the electrical system, alerts can be generated, for example, at a transformer 305.

In some cases, a single incident can trigger alerts from multiple places in the datacenter 205. In some cases, such as in a large data center, one incident can trigger hundreds or even thousands of alerts from different places. For example, a loss of power to a cooling system 240 at a datacenter can trigger an alert from a monitor (such as a monitor 295) monitoring the power supply to the cooling system 240. The chiller can separately trigger an alert due to the loss of power. The air handler 310 in turn can trigger another alert due to an increase in the air temperature. On the datacenter floor, hundreds of local cooling units can trigger additional alerts due to the temperature exceeding a pre-set level. The machines or trays 210 that are cooled by the cooling system can all trigger alerts because of the higher temperatures. Therefore, a single outage or failure (in this example, a loss of power in the cooling system) can lead to a very large number of alerts.

In some implementations, the large number of alerts can be managed more effectively using the alarm unit 320 that can be configured to identify a root cause of a set of alerts. In general, all the alerts from the computing system 229, the cooling system 240 and the electrical system 245 are sent to the alarm unit 320. From the alerts that are sent, the alarm unit 320 determines correlated alarm sets based on a knowledge base such as a system alert model 325.

In some implementations, the system alert model 325 includes a set of rules for determining correlated alarm sets. Such rules can be derived from, for example, a knowledge of system dependencies within the datacenter 205. The system alert model 325 can also include one or more of a directed graph, a workflow model, and a timeline. The system alert model 325 can also include a machine learning system such as a Bayesian classifier. In some implementations, the system alert model 325 includes a history of previous alerts and their root causes. If a machine learning system is used in the system alert model 325, such historical data can be used as training data for the machine learning system. In some implementations, the system alert model 325 can include user-defined rules created, for example, based on experience or known dependencies.

The alarm unit 320 can be configured to track incoming alerts and determine a correlated set of alerts, for example, by using a time aware Bayesian classifier. In some implementations, such a time aware Bayesian system can be configured to group alerts based on their time of occurrences. This allows determining groups or clusters of alerts that are triggered substantially close in time to one another. Studying such groups or clusters of alerts (for example, their distribution on a timeline) can facilitate determining a usual ordering of types of alerts and the corresponding triggering incidents. The ordering can therefore be used to predict occurrences of certain types of alerts and incidents based on occurrences of other alerts.

In some implementations, the alarm unit 320 can be configured to coalesce alerts based on the root cause of the correlated set of alerts. The alarm unit 320 can also be configured to predict which alerts can potentially be triggered in the future due to the identified root cause. The predicted alerts can be included in the set of correlated alerts. In some implementations, at least a subset of alerts from the correlated set of alerts (including predicted alerts as well as alerts that have already been triggered) can be suitably flagged as safe to be ignored because their root cause has been identified and/or addressed. In some cases, at least some of the predicted alerts in the correlated set of alerts can be preemptively stopped from being triggered. Various graphs, charts, or other dependency models can be used in determining the correlated set of alerts and/or predicting future alerts. Some examples of dependency models are discussed next.

Figure 4A:
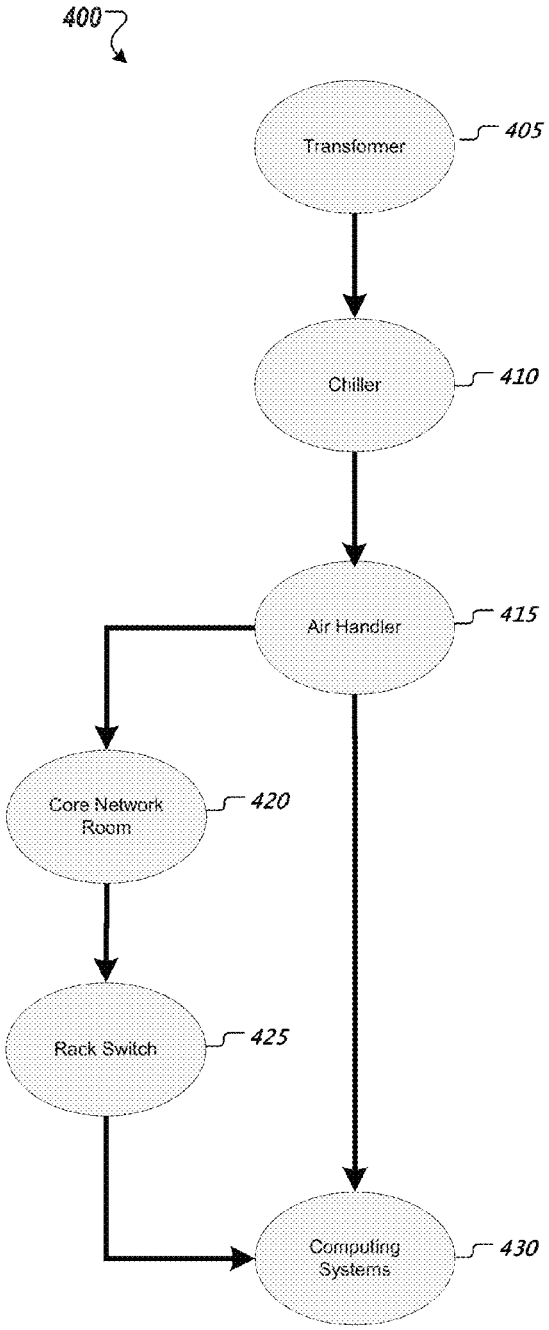
FIG. 4A is an example of a directed graph.

FIG. 4A is an example of a directed graph 400 that can be used in determining the correlated set of alerts and/or predicting future alerts. Representation of the directed graph 400 can be stored, for example, in the system alert model 325 described above with reference to FIG. 3.

The directed graph 400 shows an example of system dependencies in a datacenter. The node 405 of the directed graph represents the transformer 305 that steps down a supply voltage (e.g., voltage provided by the electric utility 230) to the voltage required by the chiller 315, represented by node 410. The chiller 315 provides cold air to an air handler (node 415) that distributes the cold air to the computing systems (node 430) such as the trays 210 in the datacenter. The trays 210 run tasks that are usually monitored for performance by other tasks. In some cases the air handler (node 415) can also be configured to supply cold air to network gear in a network room such as a core network room (CNR, node 420), which is a specialized room for handling large-scale incoming network connections. Data is routed to the computing systems (node 430) through rack switches (node 425). The directed graph 400 illustrates how a failure of a particular system (represented by a particular node) can induce failures (and hence alerts) in systems represented by downstream nodes and how a root cause can be identified using such a directed graph.

For example, if the transformer (node 405) fails, the chiller (node 410) could also fail, therefore sending out one or more alerts. Upon failure of the chiller, the air handler (node 415) would detect an increase in temperature of the air, and could send out additional alerts. Further downstream, the computing systems (node 430) could detect overheating of the processors and could send out alerts, reduce the speed of the processors, or both. In some cases, the processors may be shut down completely to prevent being burnt. The reduced speed of the processors would impact the performance of the tasks executed by the processors, which could be detected by a monitor such as the monitor 295. The monitor could trigger more alerts. Because the number of processors in a datacenter is large, failure of an upstream system such as the transformer, chiller or air handler could trigger a large number of alerts all of which have a single root-cause (e.g. failure of the upstream system or the cause thereof) or at least a much lower number of root causes. In general, such root cause identification could be beneficial in cascaded systems where failure or malfunction of an upstream system or device affects the performance of additional downstream systems. In such cases alerts that are triggered or at least could potentially be triggered at the downstream systems can be ignored, or preemptively suppressed by tracing the cause of the failures back to the failure of the upstream system.

A directed graph such as the graph 400 can be used to identify system dependencies, which can help in identifying a root cause for a large number of alerts. Such identification of root cause can be used in more efficient alert management. For example, consider a case where a many high temperature alerts are triggered at the computing systems (node 430) as well as from other parts of the datacenter. Checking the source of each individual alert can be time consuming and/or expensive. In some cases, if a large number of alerts have to be individually attended to, the cause of the alerts may go undetected for an unacceptable length of time. However, managing the large number of alerts can be simplified by checking whether any alerts have been triggered at upstream nodes (e.g. the transformer, air handler or chiller) of the directed graph 400. If an upstream alert, for example, an alert signifying a loss of power at the transformer, is detected, several of the downstream alerts from the computing systems can be determined to be correlated to the alert at the transformer. In such cases, the correlated alerts can be safely ignored with an increased degree of confidence or at least put on a low priority list for checking back on later. For example, after the transformer problem is addressed, the low priority alerts can be revisited to determine if any of those require individual attention.

Based on system dependencies, various symptoms can be determined to have a common root cause. For example, if the transformer (node 405) and consequently the air handler (node 415) fail, the CCNR (node 420) could also fail or at least malfunction due to overheating. Because of such failure or malfunction of the CCNR, packet losses may be observed at the computing systems and alerts triggered accordingly. Therefore, even when the symptom is network packet issues, the root cause determined based on the directed graph 400 could be a loss of power in the transformer, a failure of the chiller or a malfunction of the air-handler. Identification and addressing the root cause issue in such a case would simultaneously address alerts due to both the network packet issues as well as the high temperature issues.

In some implementations, the alarm unit 320 can also be used to predict alerts as well as potential malfunctions and/or failures. Continuing with the example of the directed graph 400, if alerts are detected in the CCNR (node 420), malfunctions, failures and consequent alerts can be predicted from downstream nodes such as the rack switch (node 425) or the computing systems (node 430). Therefore, if the root cause of the alerts from the CCNR is addressed, alerts from the downstream nodes can be ignored or at least treated with a low priority. The predictive mode of the alarm unit 320 is illustrated further using the example of FIG. 4B, which is an example of a timeline diagram.

Figure 4B:
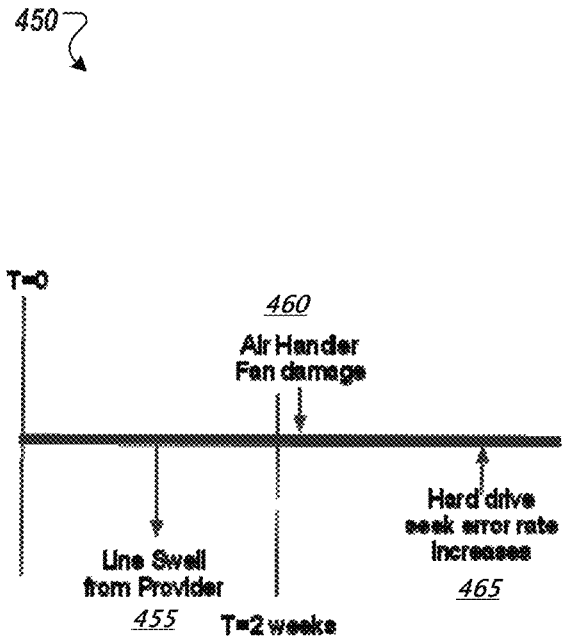
FIG. 4B is an example of a timeline diagram.

Referring to FIG. 4B, in this example, a utility swell (such as a power surge) at time point 455 causes minor damage in several components. This could be first noticed some weeks later (e.g. at time point 460) as a damage to air handler fans, the damage being manifested as, for example, an increased power requirement by the air-handling fans. Sometime later, for example, at time point 465, errors in the trays of the computing system could begin to increase. Such errors could be, for example, due to damage to a power supply unit that causes capacitors to function less effectively as filters. In some implementations, information represented by timeline diagrams (such as the timeline diagram 450) can be used to predict failures or malfunctions of additional components based on identification of root cause of alerts. For example, if the root cause for a set of alerts is identified as a utility swell, errors in the trays of computing systems can be predicted to increase within a few weeks. Accordingly, preemptive or preventive measures can be taken to avoid or at least reduce such errors. In situations such as this, the alarm unit 320 can be used in a diagnostic or predictive mode.

Even though the system alert model 325 is shown as a separate element in FIG. 3, the model can be implemented as a part of the alarm unit 320. Further, the alarm unit can be integrated into another system such as the computing system 229. For example, a tray 210 of the datacenter can be used for implementing the alarm unit 320. The alarm unit can be implemented as a software module, a hardware module or a combination of software and hardware. The system alert model 325 can be stored in a database that is accessed by the alarm unit 320. In some implementations, various systems of the datacenter 205 can be configured to communicate with the alarm unit over a wired or wireless network or a combination of wired and wireless networks. The alarm unit 320 can include one or more communication ports (e.g. Ethernet, USB, RS-232, serial port, parallel port etc.) that can be used to communicate with the systems of the datacenter 205. The alarm unit 320 can also include wireless receivers such as an infrared receiver or a Bluetooth receiver to communicate with the systems of the datacenter 205.

The alarm unit 320 can include one or more output devices (e.g. a display or a speaker) for providing outputs related to the alerts. For example, the alarm unit 320 can visually display which alerts can be ignored and which alerts should be attended to. Similarly, the output devices associated with the alarm unit 320 can be used for providing output information on root causes of correlated alarm sets. In some implementations, the output devices can be used for rendering (for example, visually) rules, models directed graphs, timeline diagrams, dependency charts or other information associated with the system alert model 325.

Figure 5:
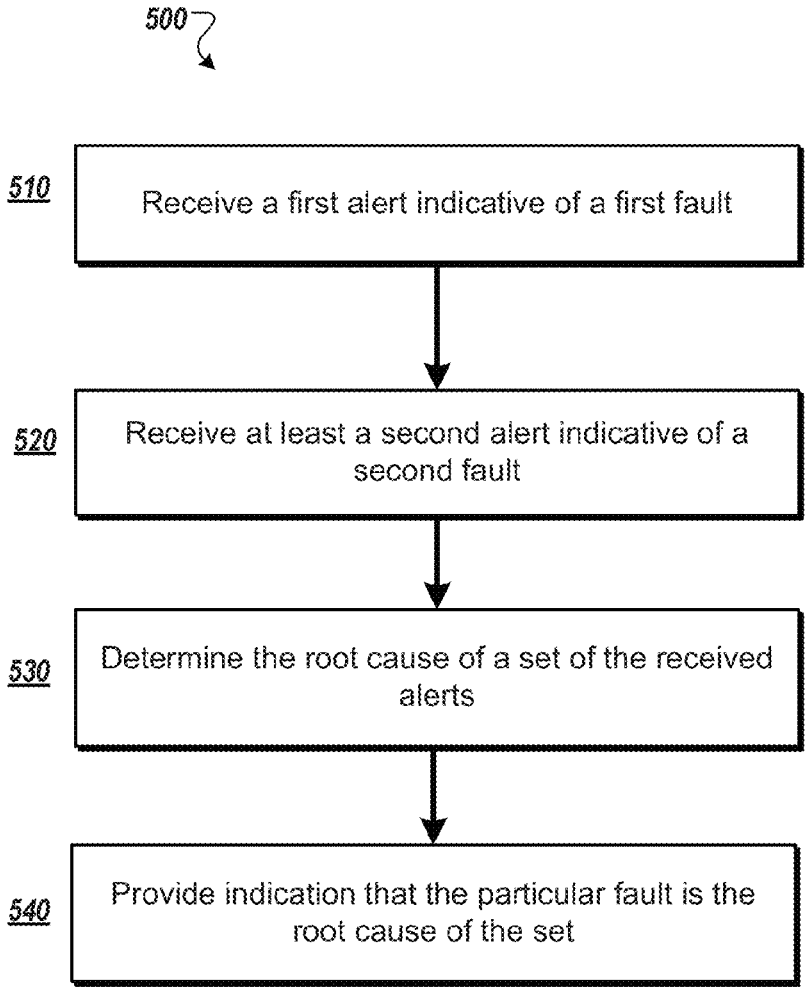
FIG. 5 is a flowchart depicting an example sequence of operations for managing multiple alerts.

Referring now to FIG. 5, a flowchart 500 shows an example sequence of operations at, for instance, the alarm unit 320 to handle multiple alerts in a data center that includes multiple, interdependent components in which a fault in one of the components can result in a cascade of faults in other components. Operations include receiving a first alert that is indicative of a first fault related to a first component of the multiple interdependent components (510). Operations also include receiving at least a second alert that is indicative of a second fault related to a second component of the multiple interdependent components (520).

In general, any number of alerts can be received at the alarm unit 320. The alerts can be received as a signal at one or more processors of the alarm unit. The alerts can also be received in the form of one or more data packets. The alerts can originate at various parts of the datacenter 205 such as the computing system 229, the cooling system 240 and the electrical system 245. Each of the alerts can be triggered by a monitor 295 upon detecting that one or more monitored parameters are outside an acceptable range. In some implementations a received alert can include various information on the alert including, for example, identification of the system where the alert originates from, fault identified by the alert, degree of criticality, and timestamp.

Operations further include determining the root cause (e.g. the first fault, which corresponds to the first alert) of a set of alerts (530). The set of alerts can include all the received alerts or can include a subset of the received alerts. In some implementations, the determined root cause can be directly responsible for triggering one or more alerts. In some implementations, determining the root cause also includes determining correlations between two or more of the received alerts. For example, if a system dependency diagram or directed graph indicates that a fault in a chiller can lead to faults in the air handler, alerts originating from the chiller and the air handler may be determined to be correlated. Whether or not two given alerts are correlated can be determined based on information from the system alert model 325. The information can include, for example, a set of predetermined rules, historical data, models, directed graphs etc. that reflect the dependency of the systems or components of the datacenter 205. In some implementations, a machine learning system such as a time aware Bayesian classifier system can be used for determining the correlation between received alerts.

Operations also include providing an indication that the particular fault (the first fault, in this example) is the root cause of the correlated set of alerts (540). Such an indication can be provided via an output device associated with the alarm unit 320. For example, a display can be used to render visually an identification of the root cause and possibly the correlated set of alerts associated with the root cause. For example, when a visual indication is provided of the alerts, the root cause may be represented in a different color, brightness or size than the downstream alerts to show their relationship. In some implementations, alerts that have not been set off, but that are predicted based on the identification of the root case are displayed as potential future alerts. In some implementations, the alerts are audio rendered alerts. In some implementations, providing indication of the root cause can further include suppressing at least some of the associated set of correlated alerts. The correlated set of alerts can also be flagged as safe to ignore.

Figure 6:
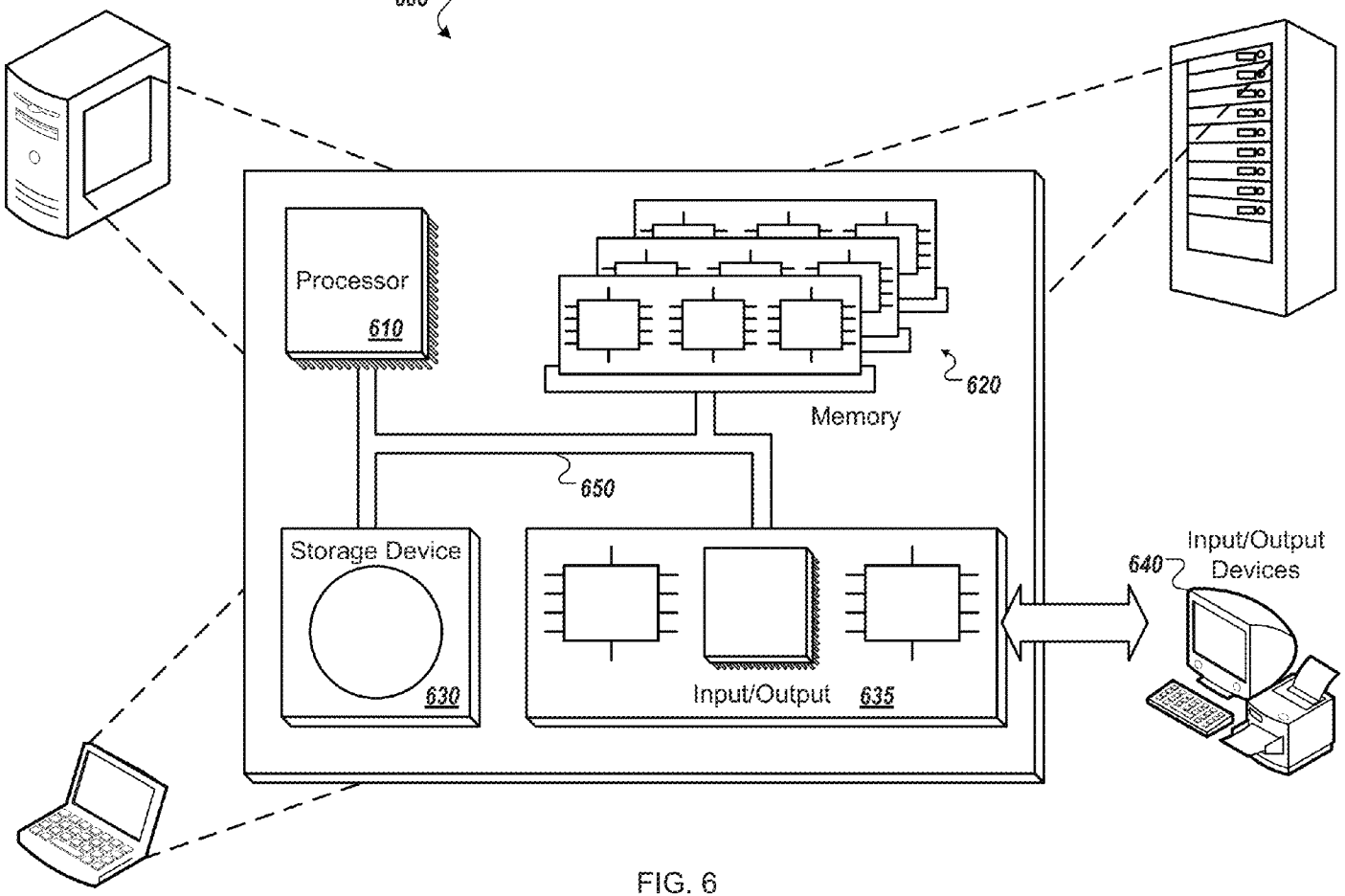
FIG. 6 is a schematic diagram of an example of a generic computer system.

FIG. 6 is a schematic diagram of an example of a generic computer system 600. The system 600 can be a part of a processing device that is used for the operations described in association with the flowchart 500 according to various implementations. For example, the system 600 may be included, at least in part, in either or all of the tray 210, the monitor 295, the computer 260, the racks 225A-225B, the alarm unit 320 and the system alert model 325.

The system 600 includes a processor 610, a memory 620, a storage device 630, and an input/output interface 635. Each of the components 610, 620, 630, and 635 are interconnected using a system bus 650. The processor 610 is capable of processing instructions for execution within the system 600. In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640. The input/output device 640 can be connected to the other components via the input/output interface 635. In some implementations, the processor 610 and the memory 620 can be substantially similar to the processor 260 and memory 265, respectively, described above with reference to FIGS. 2 and 3.

The memory 620 stores information within the system 600. In some implementations, the memory 620 is a non-transitory computer readable medium. In general, a non-transitory computer readable medium is a tangible storage medium for storing computer readable instructions and/or data. In some cases, the storage medium can be configured such that stored instructions or data are erased or replaced by new instructions and/or data. Examples of such non-transitory computer readable medium include a hard disk, solid-state storage device, magnetic memory or an optical disk. In one implementation, the memory 620 is a volatile memory unit. In another implementation, the memory 620 is a non-volatile memory unit.

The storage device 630 is capable of providing mass storage for the system 600. In one implementation, the storage device 630 is a computer-readable medium. In various different implementations, the storage device 630 may be a floppy disk device, a hard disk device, an optical disk device, or a tape device.

The input/output device 640 provides input/output operations for the system 600. In one implementation, the input/output device 640 includes a keyboard and/or pointing device. In another implementation, the input/output device 640 includes a display unit for displaying graphical user interfaces.

The features described can be implemented in digital electronic circuitry, in computer hardware, firmware, software, or in combinations of them. The apparatus can be implemented in a computer program product tangibly embodied in an information carrier, e.g., in a computer-readable storage device, for execution by a programmable processor. The method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer includes, or is operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example, semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

Although a number of implementations have been described with reference to the figures, other implementations are possible. It will be understood that various modifications may be made without departing from the spirit and scope. For example, advantageous results may be achieved if the steps of the disclosed techniques were performed in a different sequence, if components in the disclosed systems were combined in a different manner, or if the components were replaced or supplemented by other components. The functions and processes (including algorithms) may be performed in hardware, software, or a combination thereof, and some implementations may be performed on modules or hardware not identical to those described. Accordingly, other implementations are within the scope of the following claims.

What is claimed is:

1. A computer implemented method of handling alerts in a data center that includes multiple components in which a fault in one of the components can result in a cascade of faults in other components, the method comprising:

receiving, at one or more processing devices, a first alert that indicates a first fault related to a first component of the multiple components;

receiving, at the one or more processing devices, a second alert that indicates a second fault related to a second component of the multiple components, wherein the first component effects the second component such that the first fault caused the second fault;

determining, using the one or more processing devices, a correlation between the first alert and the second alert using a set of rules that is based on a directed graph that reflects dependencies associated with the multiple components, including a dependency of the second component on the first component;

based on the determined correlation, determining that the first fault is a root cause of the first alert and the second alert;

providing an indication that the first fault is the root cause of the first alert and second alert; and predicting, based on the directed graph, triggering of at least a third alert that indicates a third fault in one of the multiple components wherein the third fault occurs due to the second fault.

2. The method of claim 1 further comprising providing an indication that the second alert can be ignored.

3. The method of claim 1 further comprising suppressing the second alert.

4. The method of claim 1 wherein the first component is part of an electrical system of the data center and the second component is part of a cooling system of the data center.

5. The method of claim 1 further comprising preventing the triggering of the third alert.

6. The method of claim 1 further comprising providing an indication that the third alert can be ignored before the triggering of the third alert.

7. A data center comprising:

multiple, components in which a fault in one of the components can result in a cascade of faults in other components;

plurality of monitoring devices configured to monitor the multiple components of the data center and trigger an alert on occurrence of a fault related to a component; and an alarm unit configured to:

receive a first alert that indicates a first fault related to a first component of the multiple components, receive a second alert that indicates a second fault related to a second component of the multiple components, wherein the first fault resulted in the second fault, determine a correlation between the first alert and the second alert using a set of rules that is based on a directed graph that reflects dependencies associated with the multiple components, including a dependency of the second component on the first component, based on the determined correlation, determine that the first fault is a root cause of the first and second alerts, provide an indication that the first fault is the root cause of the first alert and the second alert, and predict, based on the directed graph, triggering of at least a third alert that indicates a third fault in one of the multiple components wherein the third fault occurs due to the second fault.

8. The data center of claim 7 wherein the alarm unit is further configured to indicate that the second alert can be ignored.

9. The data center of claim 7 wherein the alarm unit is further configured to suppress the second alert.

10. The data center of claim 7 wherein the first component is part of an electrical system of the data center and the second component is part of a cooling system of the data center.

11. The data center of claim 7 wherein the alarm unit is further configured to prevent the triggering of the third alert.

12. The data center of claim 7 wherein the alarm unit is further configured to provide an indication that the third alert can be ignored, wherein the indication is provided before the triggering of the third alert.

13. A computer program product, encoded on a computer readable storage device, operable to cause a processing device to perform operations comprising:

receiving a first alert that indicates a first fault related to a first component office-multiple components;

receiving a second alert that indicates a second fault related to a second component of the multiple components, wherein the first component effects the second component such that the first fault caused the second fault;

determining a correlation between the first alert and the second alert using a set of rules that is based on a directed graph that reflects dependencies of the multiple components, including a dependency of the second component on the first component;

based on the determined correlation, determining that the first fault is a root cause of the first alert and the second alert;

providing an indication that the first fault is the root cause of the first alert and second alert; and predicting, based on the directed graph, triggering of at least a third alert that indicates a third fault in one of the multiple components wherein the third fault occurs due to the second fault.

14. The computer program product of claim 13 further comprising instructions for providing an indication that the second alert can be ignored.

15. The computer program product of claim 13 further comprising instructions for suppressing the second alert.

16. The computer program product of claim 13 wherein the first component is part of an electrical system of a data center and the second component is part of a cooling system of the data center.

17. The computer program product of claim 13 further comprising instructions for preventing the triggering of the third alert.

18. The computer program product of claim 13 further comprising instructions for providing an indication that the third alert can be ignored before the triggering of the third alert.

* * * * *